United States Patent [19]

Weber et al.

[11] 3,938,733

[45] Feb. 17, 1976

[54] SEALED COLLECTION SYSTEM

[75] Inventors: Leonard J. Weber, Broadview; George G. Dominick, Hoffman Estates; Emad T. Moustafa, Countryside, all of Ill.

[73] Assignee: Qonaar Corporation, Elk Grove Village, Ill.

[22] Filed: Jan. 14, 1975

[21] Appl. No.: 540,803

[52] U.S. Cl. ..... 232/16; 141/346

[51] Int. Cl.[2] ..... G07B 15/00

[58] Field of Search ..... 232/16, 30, 31, 32, 15; 141/346, 65

[56] References Cited

UNITED STATES PATENTS

| | | | |
|---|---|---|---|
| 2,620,971 | 12/1952 | Hale | 232/16 |
| 2,869,777 | 1/1959 | Share | 232/16 |
| 2,992,771 | 7/1961 | McClung | 232/16 |
| 3,069,073 | 12/1962 | Laviana | 232/16 |
| 3,094,275 | 6/1963 | Pinson et al. | 232/16 |
| 3,297,064 | 1/1967 | Moore et al. | 141/346 X |
| 3,807,628 | 4/1974 | Bock | 232/16 |
| R28,307 | 1/1975 | Dominick et al. | 232/16 |

*Primary Examiner*—Roy D. Frazier
*Assistant Examiner*—Peter A. Aschenbrenner
*Attorney, Agent, or Firm*—McDougall, Hersh & Scott

[57] ABSTRACT

A system for handling coins and the like which includes a storage housing having a discharge opening with the discharge opening being normally closed by a locked door. A coin transfer mechanism including a tubular housing is adapted to be attached to the storage housing and held firmly in place on this housing. A key structure is associated with the transfer mechanism whereby the door can be unlocked and pulled to an open position at which time the coins are discharged into a collection area associated with the transfer mechanism. The design of the transfer mechanism and the means for holding this mechanism in place on the storage housing prevent any access to the coins during the collection operation.

13 Claims, 20 Drawing Figures

FIG. 12
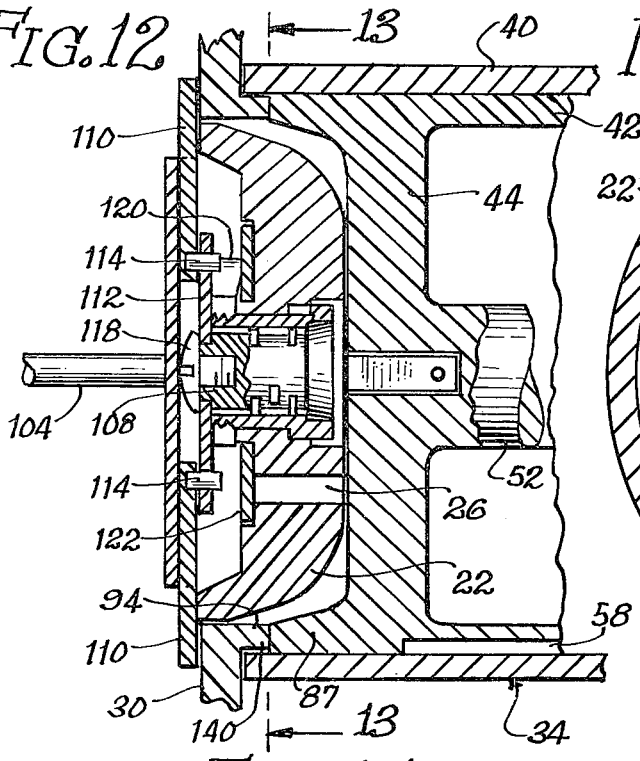
FIG. 13
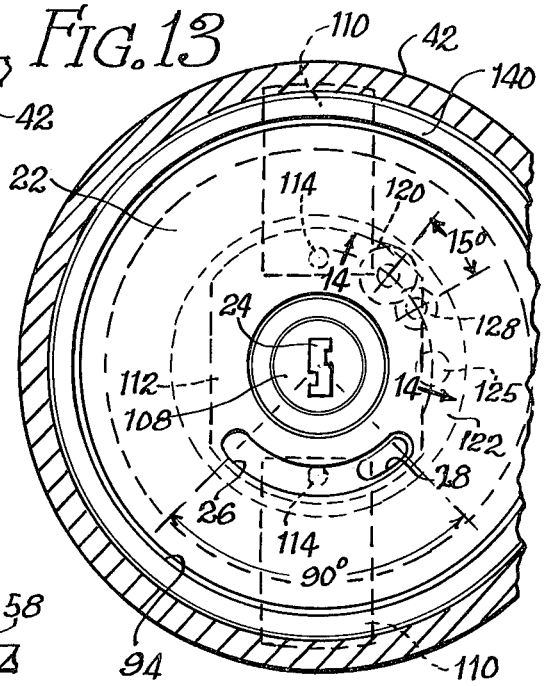
FIG. 14
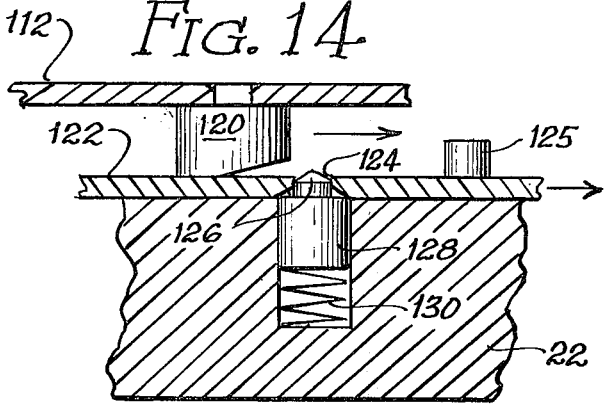
FIG. 15
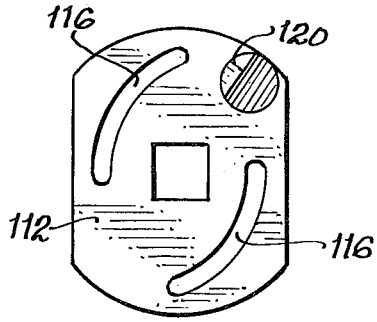
FIG. 17
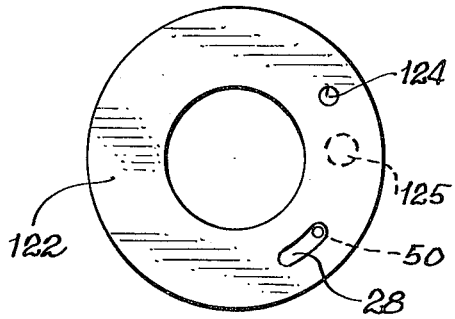
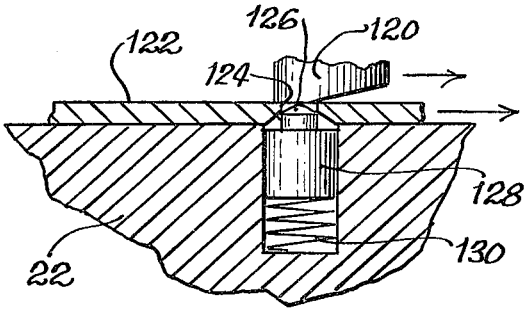
FIG. 16

SEALED COLLECTION SYSTEM

This invention relates to a collection system for valuables. In a typical operation, the valuables will comprise money or tokens as are collected in parking meters. The following description will make reference to the collection of coins for convenience in explaining the subject matter of the invention, however, it will be understood that this terminology is intended to include a variety of valuables including paper money and tokens.

As noted, the invention has application to the collection of coins from parking meters. The following description will illustrate the application of the invention in this area; however, it will be understood that the invention is applicable to other collection operations, for example, in transit operations, vending machines, etc.

In coin collecting operations involving a large number of collection operations, there is a definite danger of loss either because of mishandling or pilferage. Thus, where parking meters are involved, a collector will move from meter to meter, and empty the contents thereof into a large collection housing. If this operation permits the collector to directly handle the coins, loss or pilferage can easily result. Accordingly, various systems have been designed for purposes of preventing handling of the coins, such systems being described in Klemt U.S. Pat. No. 2,277,916, Eames U.S. Pat. No. 2,813,674, Sollenberger U.S. Pat. No. 2,815,166, Share U.S. Pat. No. 2,869,777, Share U.S. Pat. No. 2,869,778, McClung U.S. Pat. No. 2,992,771, Share U.S. Pat. No. 3,034,705, Lewis U.S. Pat. No. 3,074,626, White U.S. Pat. No. 3,118,597, McGoldrick U.S. Pat. No. 3,239,046 and Karp U.S. Pat. No. 3,297,242.

It is a general object of this invention to provide an improved collection system for parking meters and the like.

It is a more particular object of this invention to provide a collection system for parking meters and the like wherein the coins are discharged from a storage housing of the meter or other structure in a highly efficient and secure fashion.

It is a still further object of this invention to provide a collection system which is improved over prior art systems in terms of ease of operation so that the contents of a storage housing in a parking meter or similar structure can be rapidly collected with a minimum amount of training of a collector being involved.

It is a still further object of this invention to provide a collection system of the type described which is improved with respect to prior art systems in terms of efficiency and security, particularly since the contents of a storage housing of a meter or the like can be rapidly collected without sacrificing the high security of the meter as it stands on the street.

It is a still further object of this invention to provide a meter construction which accomplishes the foregoing object while at the same time providing high security for collected coins and the like during transfer into a common collection area.

These and other objects of this invention will appear hereinafter and for purposes of illustration, but not of limitation, specific examples of the invention are shown in the accompanying drawings in which:

FIG. 12 is an enlarged fragmentary, cross-sectional view particularly illustrating the door lock construction;

FIG. 13 is a cross-sectional view taken about the line 13—13 of FIG. 12;

FIG. 14 is an enlarged fragmentary, cross-sectional view illustrating a locking pin structure utilized in the construction;

FIG. 15 is a plan view of a plate and cam pin structure associated with the door;

FIG. 16 is an enlarged fragmentary, cross-sectional view comprising a further view of the locking mechanism details;

FIG. 17 is a plan view of a ring element utilized in the door;

Figure 1:
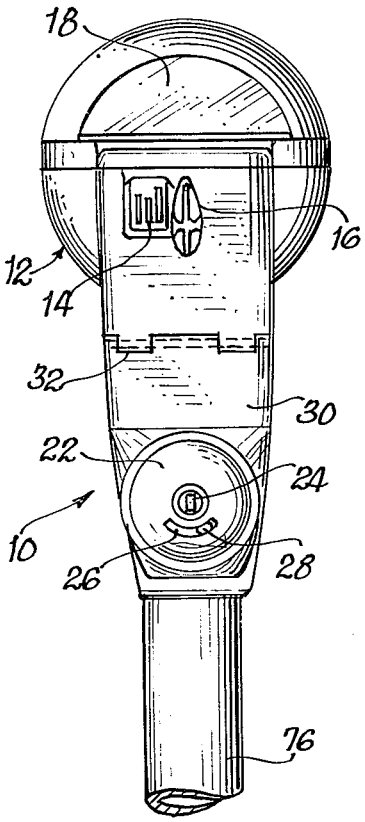
FIG. 1 is a front elevational view of a parking meter characterized by certain features of the invention, this view being taken about the line 1—1 of FIG. 2.

This invention generally relates to a system for handling coins and the like including a storage housing for the coins. This housing, which may be a parking meter, is provided with a high security door to prevent access to the coins when the coins are stored in the meter. The door is normally locked, and is only to be unlocked by an authorized collector.

The collection system of the invention includes a transfer mechanism which is adapted to be temporarily held in place on the meter. This transfer mechanism includes a tubular housing within which there is mounted a movable plate carrying a key for unlocking the door. By moving the key into the lock, rotating the key, and then retracting the plate with the door secured thereto, the coins in the meter will be discharged into the transfer mechanism and then collected in any suitable container. This collection can be accomplished only with the transfer mechanism in place, and the housing of the transfer mechanism guards against any access to the coins in the meter.

The transfer mechanism includes arms which extend into engagement with the parking meter and which are automatically locked into a holding relationship with respect to the parking meter as soon as the coin transfer operation begins. Once locked in place, the arms cannot be unlocked during the entire course of the discharge of coins from the meter. The arms are only unlocked for purposes of releasing the transfer mechanism relative to the meter after the door to the meter has been returned to its normal position and relocked.

The accompanying drawings illustrate a parking meter 10 which includes an upper housing section 12 having features characteristic of such meters. Coin slots 14 are provided for the deposit of coins depending upon the amount of parking time desired. A handle 16 is employed for operating the timing mechanism of the meter, and the amount of time purchased is normally displayed through transparent windows 18. A lock 20 which normally secures the upper housing is shown at 20, and this permits access to the upper housing portion for maintenance purposes and the like.

The lower housing portion of the meter is provided with a coin storage area. Access to this area is normally blocked by door 22, and this door defines a keyhole 24 for use in unlocking the door in the manner to be described. A large slot 26 is defined by the door and a smaller slot 28 is defined by a ring carried by the door as will be more fully explained. It will be noted that the lower housing front wall portion 30 is hinged at 32, and this entire section is normally locked by a separate lock (not shown) whereby access can be obtained to the lower housing primarily for maintenance purposes.

As indicated, the invention is particularly concerned with a transfer mechanism generally shown at 34 in the drawings. This transfer mechanism includes a downwardly extending pipe section 36 which is connected to a hose 38. As will be explained, coins are discharged into the pipe section and hose, and any suitable collecting chamber will be disposed at the end of the hose. The coins collected may simply fall by gravity into the chamber; however, particularly where paper money is involved, a vacuum system may be utilized for purposes of assisting in the discharge of the valuables.

The transfer mechanism includes a tubular housing 40 which is preferably cylindrical as illustrated, and which serves to support the pipe section 36. A reciprocating structure 42 is received within the housing 40, and this section defines a transversely extending plate 44. A key 46 designed for receipt within the keyhole 24 is secured to the plate 44. A pin defining a large diameter section 48 and a small diameter section 50 is also mounted on the plate 44 for receipt within the slots 26 and 28.

A perpendicularly extending shaft 52 is formed integrally with the plate 44, and a knob 54 is mounted on the end of this shaft. The knob 54 serves as a means for manually reciprocating the structure 42 and for rotating this structure relative to the housing 40. The housing and structure 42 are tied together by means of a pin 56 which extends through the wall of the housing 40. The structure 42 defines a first longitudinally extending groove 58, a transversely extending groove 60, and a second longitudinally extending groove 62. These grooves form a U-shaped channel for receiving the pin 56 and for precisely defining the limits of relative movement between the structure 42 and tubular housing 40. The pin should be a difficult-to-remove element, and it is also contemplated that a lead seal or similar identifying means be associated with the pin for purposes of detecting any tampering.

Figure 2:
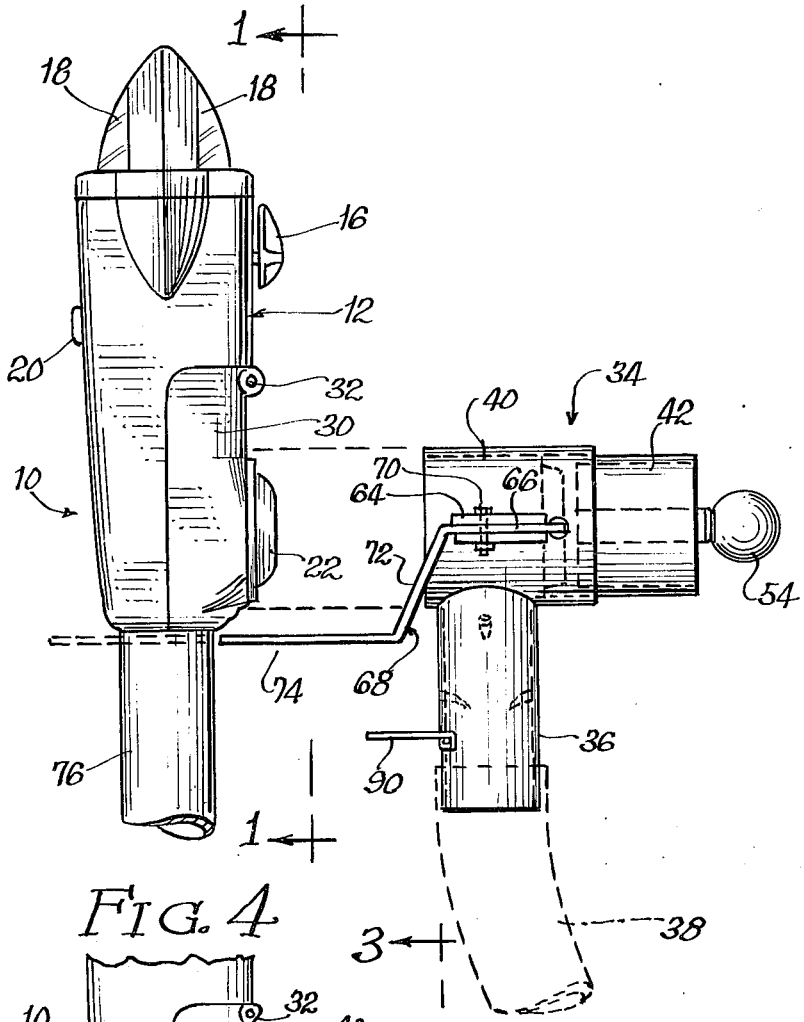
FIG. 2 is a side elevation of the parking meter illustrated in conjunction with a transfer mechanism of the type contemplated by this invention.
Figure 3:
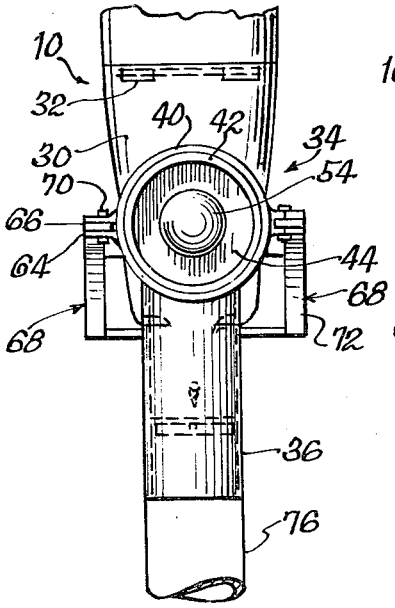
FIG. 3 is an elevational view of the transfer mechanism in association with the meter taken about the line 3—3 of FIG. 4.
Figure 4:
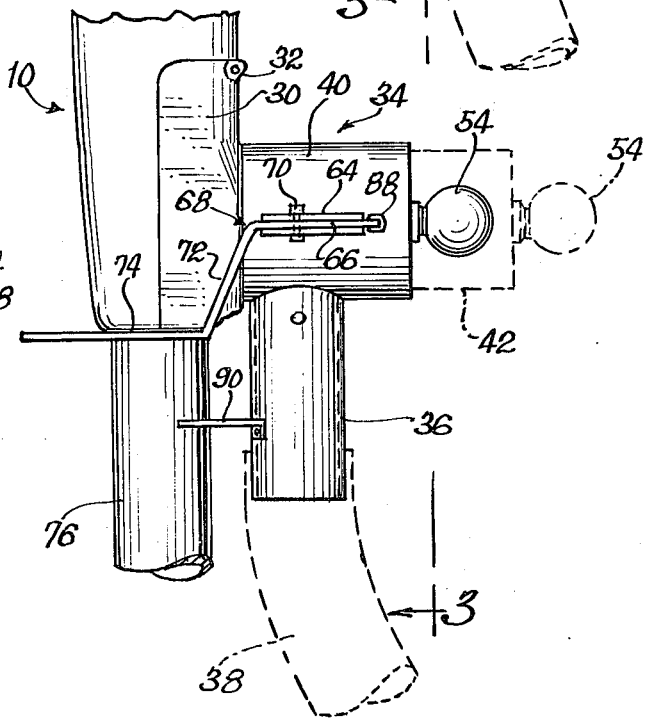
FIG. 4 is a side elevation of the assembly shown in FIG. 3.

The tubular housing 40 defines a bifurcated flange element 64 on both sides thereof. The ends 66 of holding arms 68 are received by these flange elements, and bolts 70 serve to pivotally secure these ends to the elements 64. As best illustrated in FIGS. 2 and 4, the arms include an intermediate section 72 which locates the ends 66 in a plane above the operating ends 74 of the arms. This design is employed for parking meters of the type illustrated wherein the junction of the meter supporting post 76 is located adjacent and just below the door 22. It will be appreciated that the particular design of the arms including the dimensions thereof can be varied to accommodate meters or other structures of a somewhat different design.

Figure 18:
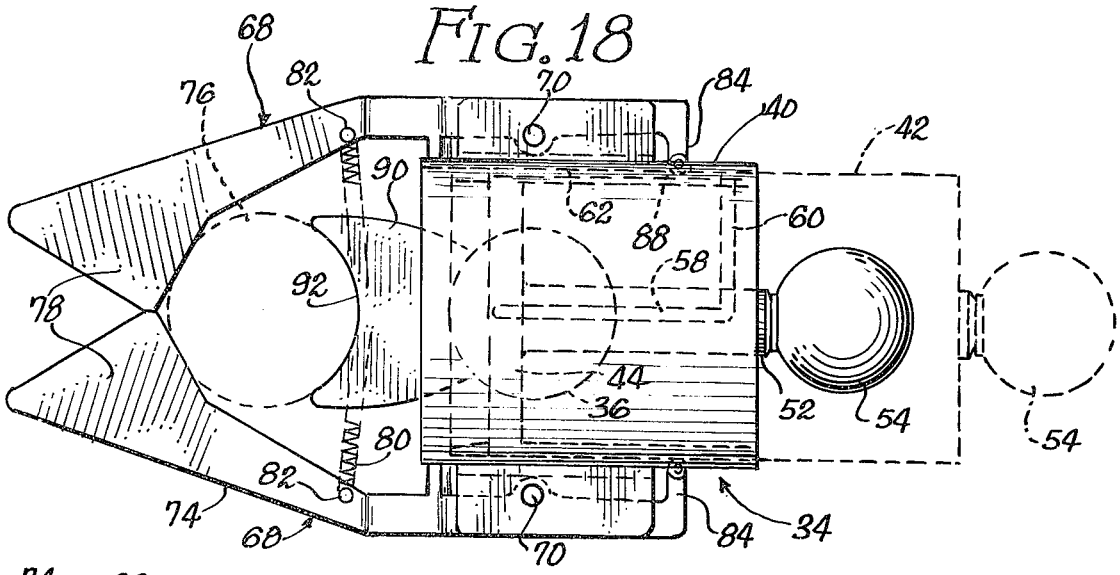
FIG. 18 is a plan view of the transfer mechanism shown held in place in association with a meter.
Figure 19:
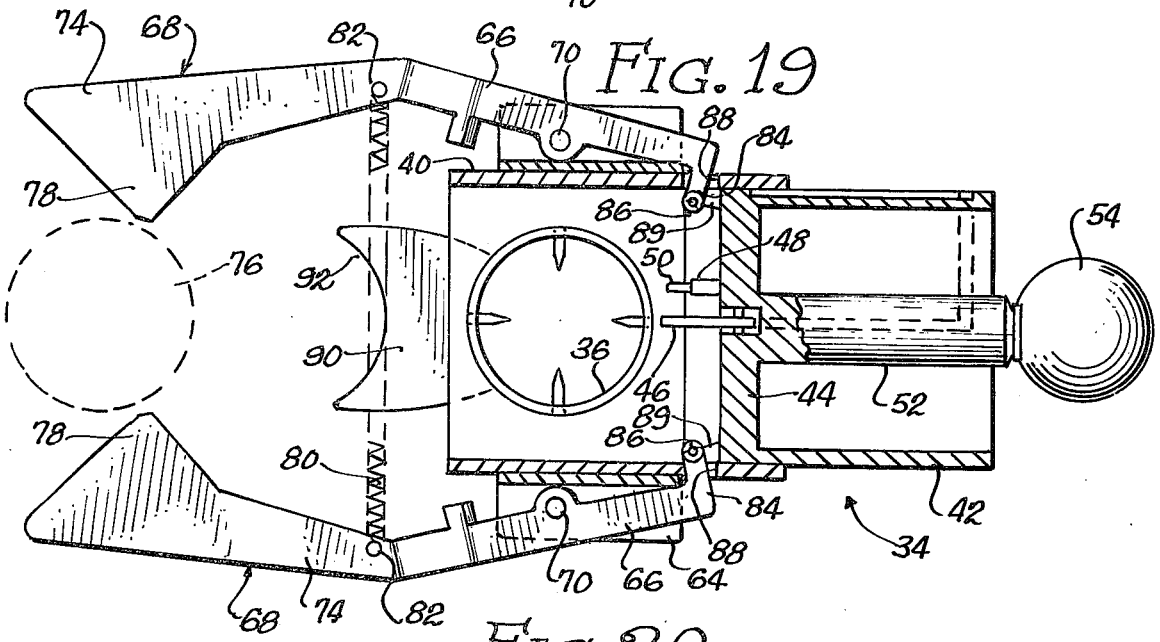
FIG. 19 is an illustration of the transfer mechanism when released relative to the meter; and, FIG. 20 is a perspective view illustrating the transfer mechanism and door associated with the meter storage housing.
Figure 20:
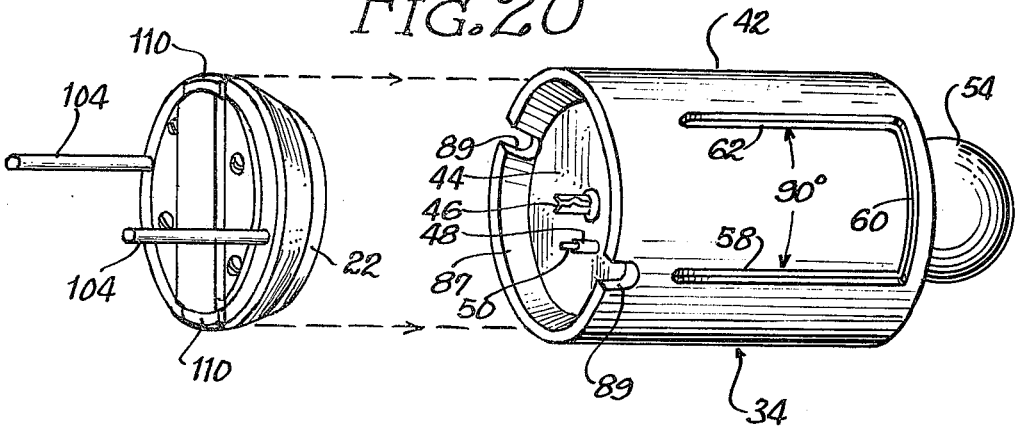

As best illustrated in FIGS. 18 and 19, the operating ends 74 of the arms 68 include inwardly extending portions 78. In the illustration of FIG. 18, these arms are shown in the holding position wherein the portions 78 embrace the post 76. In FIG. 19, the arms are spread whereby the portions 78 are clear of the post. The condition of FIG. 19 is realized during mounting of the transfer mechanism on the post and during removal of the transfer mechanism. A spring 80 has its respective ends attached to pins 82 supported by the arms 68. This spring normally holds the arms in the position shown in FIG. 18. The arms are, therefore, forced around the post 76 during mounting and removal operations in opposition to the action of spring 80.

The ends 66 of the arms 68 define turned-in portions 84 with these portions preferably carrying small rollers 86. Openings 88 are defined by the wall of tubular housing 40, and slotted openings 89 are defined by an annular flange 87 carried by the structure 42. These aligned openings are adapted to receive the end portion 84 and rollers 86 when the arms are pivoted outwardly as shown in FIG. 19. When the structure 42 is moved inwardly as shown in FIG. 18, the openings 88 are blocked. Accordingly, the inward movement of the structure 42 prevents spreading of the arms so that the transfer mechanism cannot be removed from engagement with the post 76 when the structure 42 has been moved inwardly. As will be more fully explained, the structure 42 must be moved inwardly in order to open the door 22. Accordingly, the door will only be open when the transfer mechanism is in place as shown in FIG. 18, and it will be apparent that the transfer mechanism design is such that it prevents access to the valuables being discharged. It will be noted in this connection that the plate 44 serves as a complete barrier with respect to the door 22 when the transfer mechanism is in place. This greatly minimizes the possibility of any pilfering during discharging movement.

Figure 5:
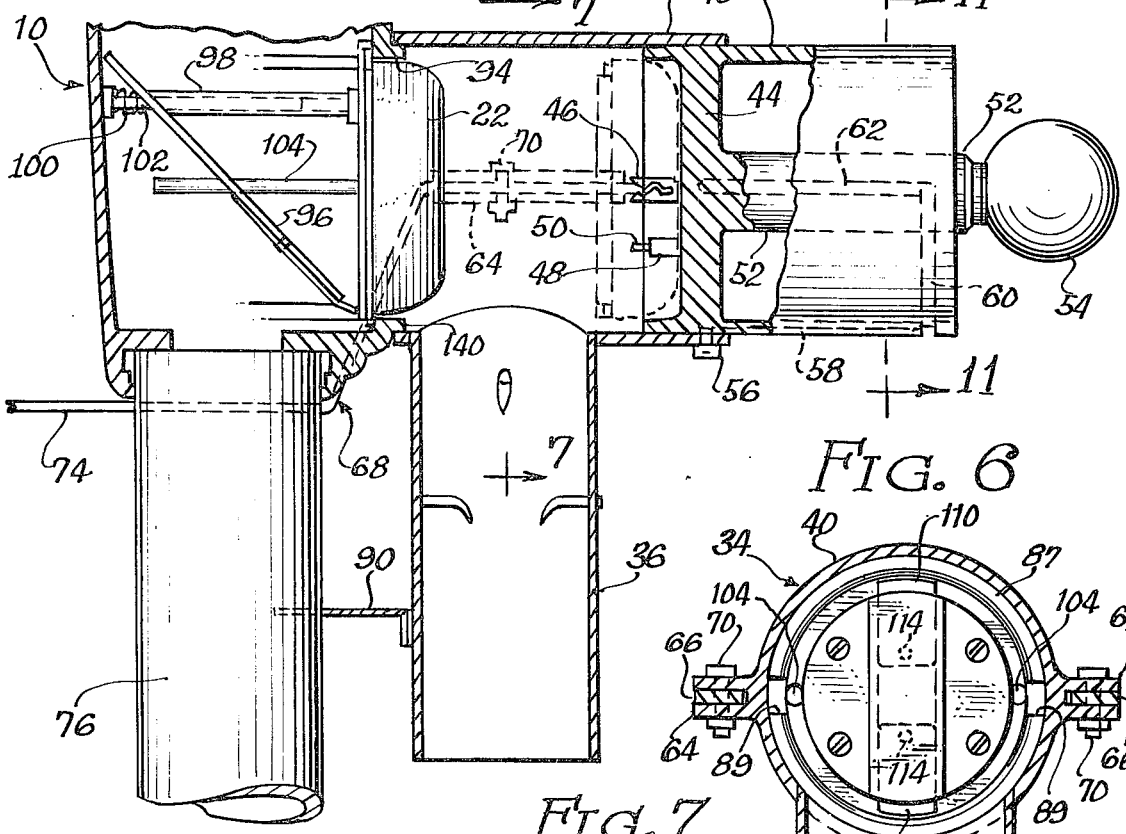
FIG. 5 is an enlarged fragmentary, cross-sectional view illustrating the transfer mechanism in combination with a meter.
Figure 6:
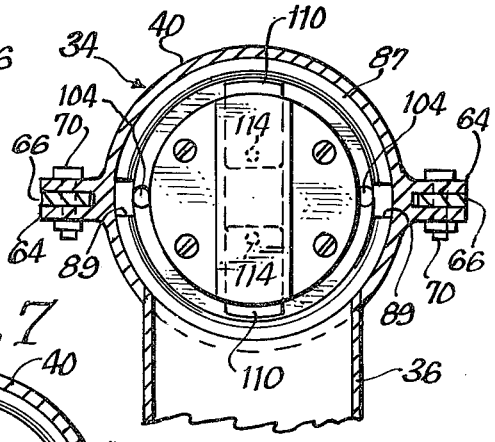
FIG. 6 is a fragmentary, cross-sectional view illustrating the meter door construction in the coin discharge position of the transfer mechanism.
Figure 7:
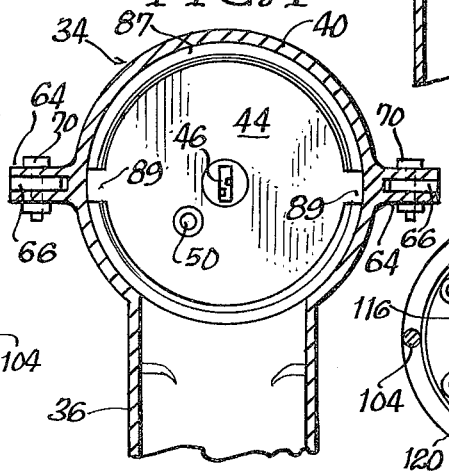
FIG. 7 is a cross-sectional view taken about the line 7—7 of FIG. 5.
Figure 8:
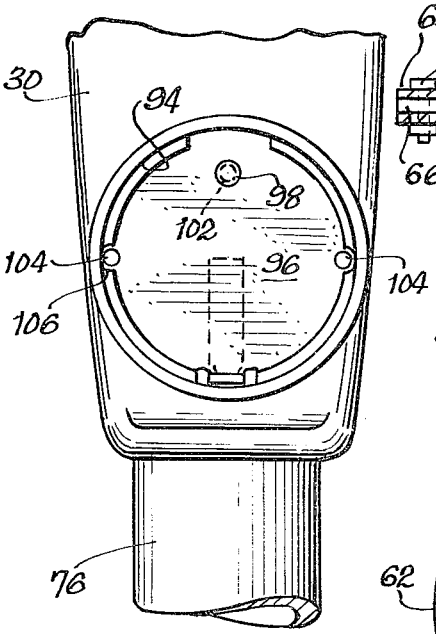
FIG. 8 is a fragmentary, elevational view of the meter with the coin storage housing door removed.

A stabilizing plate 90 is attached to the pipe section 36 of the transfer mechanism. This plate defines a post engaging edge 92 which serves to stabilize the transfer mechanism when it is situated in place as shown in FIG. 5. Thus, the plate 90 particularly prevents any rocking or bending movement of the transfer mechanism during a discharge operation.

The door 22 is received within a discharge opening 94 defined by the lower housing of the meter. A coin slide 96 is positioned behind this opening, and a hollow post 98 is carried by the slide. A rod 100 is attached to the back wall of the lower housing, and a spring 102 is positioned around the rod for normally urging the slide 96 toward the front of the meter. Thus, the slide is movable since the rod 100 is freely received within the hollow interior of the post 98.

A pair of guide rods 104 are attached to the door 22. The slide 96 carries ears 106 defining openings receiving the rods 104. These rods, therefore, serve to guide the slide 96 during forward movement of the slide.

Figure 9:
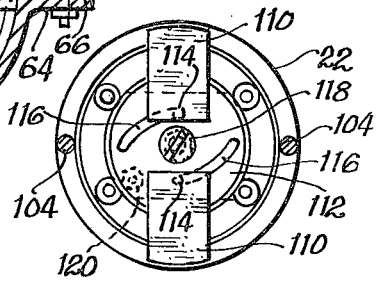
FIG. 9 is a rear elevational view of the coin storage door shown in the unlocked position and with a back plate thereof removed.
Figure 11:
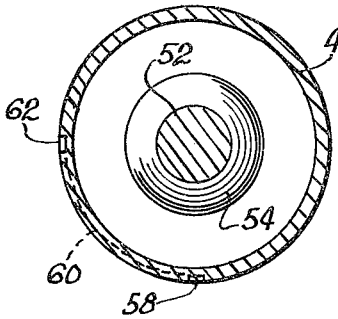
FIG. 11 is a cross-sectional view of the transfer mechanism taken about the line 11—11 of FIG. 5.
Figure 10:
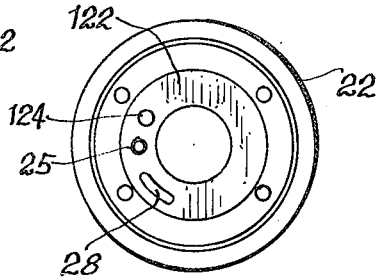
FIG. 10 is an elevational view of an interior section of the door construction.

The lock structure in the door 22 includes a rotatable lock plug 108 which is rendered free for rotation in the normal fashion when a proper key is inserted in the keyhole 24. A pair of bolts 110 are tied to plate 112 by means of pins 114. As shown in FIG. 15, the plate 112 defines arcuate slots 116, and the pins 114 are movable in these slots. The plate 112 is fastened to the plug 108 by means of screw 118. Accordingly, when the plug is rotated, the plate 112 causes movement of the bolts 110. In FIGS. 12, 13 and 15, the plate is illustrated in the position which locates the bolts in the locked position. When the plate is rotated 90° as shown in FIG. 9, the bolts are moved to the unlocked position.

The plate 112 carries a cam pin 120 which extends into engagement with ring 122 mounted on the door 22. The ring 122 defines the slot 28, and this slot receives the small diameter pin section 50 mounted adjacent the key 46. The ring 122 is addition defines an opening 124 which receives the end 126 of the plunger 128 (FIG. 14). This plunger is normally urged into the opening 124 by means of spring 130, and the plunger is designed so that the ring 122 cannot be rotated unless the plunger is depressed. The movement of plate 112 and associated cam pin 120 serves to depress the plunger and to free the ring 122 for rotation as will be more fully explained. An arresting pin 125 is positioned on the ring 122 for a purpose which will also be explained.

In the operation of the described system, the transfer mechanism 34 is first brought into position adjacent a meter in the manner shown in FIGS. 2 and 19. By moving the mechanism from right to left, the arms 68 are caused to spread outwardly, and this is possible because the structure 42 is retracted and does not interfere with pivoting of the arms. When the edge 92 of the stabilizing plate 90 engages the post 76, the arms 68 will have moved into a holding position.

The structure 42 is at this point moved forward by pushing inwardly on knob 54. Since the groove 58 of the structure must be in alignment with the pin 56, the structure 42 is accurately guided so that the key 46 will automatically enter the keyhole 24, and the pin sections 48 and 50 will enter, respectively, the slots 26 and 28. As soon as the forward movement of the structure 42 commences, the outer wall of the structure covers the openings 88 in the tubular housing 40 so that the arms 68 are restrained against pivoting movement.

When the key enters the keyhole, the pin 56 of the tubular housing 40 is aligned with the groove 60 of the structure 42. The structure is, therefore, free for rotation by means of the knob 54. It will be noted that the rotary movement of the structure 42 moves the slotted openings 89 out of alignment with respect to the openings 88. Accordingly, the arm 68 cannot be pivoted to release the transfer mechanism whenever the structure 42 has been rotated away from the position of FIG. 19. This is true even when the structure 42 has been retracted to open the door 22 during a discharge operation.

With the key and pin sections in position within the door, rotation of the structure 42 initially results in rotation of the bolt actuating plate 112. The pin section 50 moves within slot 28 for about 15° of movement before engagement between the pin section and the ring 122. During this movement, the cam pin 120 operates to depress the plunger 128 (FIG. 16) which thereby frees the ring 122. For the remaining rotation of the structure 42, the ring 122 moves with the plate 112. The arresting pin 125 is provided for purposes of preventing operation when a key only is employed. Thus, the key will still serve to rotate the plate 112; however, in that instance, the cam pin 120 will by-pass the plunger 128 since movement of the ring 122 will not occur. As the cam pin 120 continues, it engages the arresting pin 125 preventing further movement of the plate 112. Thus, the plunger 128 will be restored locking the ring 122 and arresting pin 125 in position. Without the continued movement of the plate 112, the bolts 110 will remain in the locked position.

Once the plate 112 has moved through 90°, the door 22 is unlocked and the door is then withdrawn by pulling on the knob 54. The guide slot 62 is now in alignment with groove pin 56 for purposes of guiding this retraction. As the door 22 is withdrawn, the spring 100 forces the slide 96 forwardly whereby all coins resting on the slide are caused to move into the tubular housing 40 and downwardly through pipe section 36 and hose 38. The forward movement of the slide is only sufficient to enable the end of the slide to clear the peripheral lip 140 of the opening 94 thereby insuring that all coins will drop into the collection area.

The door 22 is closed by simply reversing the described operations. Thus, the knob 54 is used to move the door back to its closed position, and it will be noted that the distance of movement is precisely controlled. Thus, the structure 42 must be moved sufficiently to bring the slot 60 into alignment with pin 56. Upon rotation of the structure 42, the key 46 returns the bolts 110 to a locked position. The knob 54 is then employed for retracting the structure 42, and it is only at this point that the openings 88 and 89 are in alignment to permit release of the transfer mechanism.

It will be appreciated that the described structure provides a very simple but highly secure means for collecting coins or other valuables from a parking meter or other storage structure. The system is of particular merit in view of the fact that automatic alignment for operating purposes is achieved when the structure is located in position. It will be noted in this connection that the tubular housing 40 defines an open end which has an interior diameter corresponding with the outer diameter of the flange 140 defined by the meter housing. With this arrangement, the tubular housing is automatically centered with respect to the door 22. Similarly, the provision of the stabilizing plate 90 insures proper alignment of the structural elements.

Once the transfer mechanism is located in position, the collection operation consists merely of simple movements affected by the knob 54. Thus, the knob 54 is pushed inwardly, rotated through 90°, retracted, then pushed inwardly again, rotated back through 90° and again retracted. The retracting movement automatically releases the holding action of arms 68 whereby the transfer mechanism can be readily removed from the meter and then moved to the next meter. In this connection, the transfer mechanism may be associated with a portable cart which includes a vault area so that the valuables collected are always maintained under high security conditions.

It will be understood that various changes and modifications may be made in the above described system which provide the characteristics of this invention without departing from the spirit thereof, particularly as defined in the following claims.

What is claimed is:

1. In a system for handling coins and the like including a storage housing for the coins, a door for said storage housing, a lock for said door, and a transfer mechanism for use in removing the coins from the housing, the improvement comprising means for holding the transfer mechanism in position on the housing, said holding means comprising a pair of arms pivotally connected to said transfer mechanism, means permitting spreading of the arms for location of the arms around a housing portion, means for moving the arms together for holding engagement of the arms with the housing portion, and means for retaining the arms in said holding engagement during transfer of coins from said storage housing to said transfer mechanism, said transfer mechanism including means for operating the lock to open and to then relock the door, and wherein said arms are retained in said holding engagement until said door has been relocked.

2. A system in accordance with claim 1 wherein said transfer mechanism includes a reciprocating carrier for said means for operating the lock, said means for retaining the arms in said holding engagement being provided by said carrier means.

3. A system in accordance with claim 2 wherein said arms define extensions at the ends thereof, said carrier means defining an opening for receiving said extensions during spreading of the arms, movement of the carrier means moving said openings out of position relative to said extensions for thereby blocking pivoting movement of the arms.

4. A system in accordance with claim 3 wherein said carrier means are movable inwardly for engagement of said key with said lock, are rotated for opening of said lock, are movable outwardly with said door attached thereto for opening of the door, are movable inwardly for returning of the door to the closed position, are rotatable for relocking of said lock, and are movable outwardly for release of the carrier means relative to the door.

5. A system in accordance with claim 1 including spring means for normally holding said arms in the retaining position, spreading of said arms occurring in opposition to the action of said spring means.

6. A system in accordance with claim 5 wherein said storage housing is mounted on a supporting post, said arms defining inwardly extending ends for embracing the post when the arms are in said holding engagement.

7. A system in accordance with claim 6 including a stabilizing element carried by said transfer mechanism, said stabilizing element being engageable with said post at a point spaced away from said arms, said stabilizing element assisting in holding said transfer mechanism in position relative to said post.

8. In a system for handling coins and the like including a storage housing for the coins, a discharge opening defined by the storage housing, a door normally closing the discharge opening, a lock on said door for normally preventing opening of the door and access to the coins therein, and a transfer mechanism for removing the coins from the housing, the improvement wherein said transfer mechanism comprises a plate disposed substantially parallel with said door, a tubular housing reciprocally receiving said plate, said plate substantially completely blocking access to the interior of said tubular housing, a key mounted on said plate, means carried by said transfer mechanism for moving said plate to a position adjacent said door whereby said key enters said lock, means for rotating said plate and key to unlock said lock, means operating responsive to said rotating of said plate for securing said transfer mechanism to said storage housing, means for retracting said plate to move said door away from said storage housing whereby the coins therein are discharged through said discharge opening into said tubular housing, and means for maintaining said transfer mechanism secured to said storage housing during said movement of said door, said tubular housing defining an open end, means defined by said storage housing for seating said tubular housing with said door being received within said open end, said plate being supported on a substantially tubular structure reciprocal within and rotatable within said tubular housing, a guide pin and a grooved track, said pin and track being defined by said tubular housing and tubular structure for controlling the path of reciprocal and rotary movement of the tubular structure relative to the tubular housing.

9. A system in accordance with claim 8 including a knob carried by said tubular structure for imparting reciprocal and rotary movement thereto.

10. A system in accordance with claim 9 including bolt means associated with said lock, a lock plate for rotation by said key, said lock plate being operatively connected to said bolt means, a lock ring including an arresting member, means for preventing rotation of said lock ring, means associated with said lock plate for disengaging said preventing means, and a drive pin associated with said key for moving said lock ring to drive the arresting member of said lock ring out of engaging position relative to said lock plate whereby said lock plate is adapted to move said bolt means to the unlocked position only when said drive pin moves said arresting member.

11. In a system for handling coins and the like including a storage housing for the coins, a discharge opening defined by the storage housing, a door normally closing the discharge opening, a lock on said door for normally preventing opening of the door and access to the coins therein, and a transfer mechanism for removing the coins from the housing, the improvement wherein said transfer mechanism comprises a plate disposed substantially parallel with said door, a tubular housing reciprocally receiving said plate, said plate substantially completely blocking access to the interior of said tubular housing, a key mounted on said plate, means carried by said transfer mechanism for moving said plate to a position adjacent said door whereby said key enters said lock, means for rotating said plate and key to unlock said lock, means operating responsive to said rotating of said plate for securing said transfer mechanism to said storage housing, means for retracting said plate to move said door away from said storage housing whereby the coins therein are discharged through said discharge opening into said tubular housing, means for maintaining said transfer mechanism secured to said storage housing during said movement of said door, a slide plate mounted in an angular position within said storage housing, coins within said storage housing being disposed on said slide plate, spring means normally forcing said slide plate toward said discharge opening whereby said slide plate moves toward said transfer mechanism when said door is opened, opening of said door resulting in said coins sliding off said plate into said transfer mechanism.

12. A system in accordance with claim 11 including guide rod means carried by said door, said slide plate defining at least one opening for receiving said guide rod means whereby the door and slide plate are maintained in alignment with each other.

13. In a system for handling coins and the like including a housing for the coins, a discharge opening defined by the storage housing, a door for said housing normally closing access to the housing, and a lock having a rotatable lock plug mounted on said door, the improvement in means for opening said lock comprising a key, a pin, a common mounting for said key and pin, an opening defined in said door for receiving said pin as said key is inserted in said lock, means for rotating said common mounting, a stop member movably mounted on said door for blocking movement of said lock plug, holding means normally preventing movement of said stop member relative to the door to thereby retain the stop member in a blocking position, release means operatively connected to said lock plug for disengaging said holding means, rotation of said lock plug by said key causing said release means to disengage said holding means, said pin engaging said stop member with the movement of the pin moving said stop member out of blocking position whereby rotation of said lock plug in the absence of said pin retains said stop member in blocking position, said stop member being mounted on a ring, a plunger extending into an opening defined by the ring to prevent movement of the ring, a plate connected to said lock plug, said release means comprising a cam element mounted on said plate for engaging said plunger during movement of the plate to thereby move said plunger out of the opening defined by the ring.

* * * * *